US005643050A

United States Patent [19]

Chen

[11] Patent Number: 5,643,050

[45] Date of Patent: Jul. 1, 1997

[54] CHEMICAL/MECHANICAL POLISH (CMP) THICKNESS MONITOR

[75] Inventor: Lai-Juh Chen, Hsin-Chu, Taiwan

[73] Assignee: Industrial Technology Research Institute, Hsinchu, Taiwan

[21] Appl. No.: 652,218

[22] Filed: May 23, 1996

[51] Int. Cl.[6] ..... B24B 49/00; B24B 51/00

[52] U.S. Cl. ..... 451/10; 451/5; 451/6; 451/7; 451/8; 451/287; 451/288; 451/289; 451/41; 451/53

[58] Field of Search ..... 457/5, 6, 7, 8, 457/53, 41, 285–289

[56] References Cited

U.S. PATENT DOCUMENTS

| | | | |
|---|---|---|---|
| 4,351,029 | 9/1982 | Maxey et al. | 364/511 |
| 4,471,579 | 9/1984 | Bovensiepen | 451/53 |
| 5,113,622 | 5/1992 | Nishiguchi et al. | 451/7 |
| 5,127,196 | 7/1992 | Morimoto et al. | 451/53 |
| 5,196,353 | 3/1993 | Sandhu et al. | 437/8 |
| 5,234,868 | 8/1993 | Cote | 437/225 |
| 5,240,552 | 8/1993 | Yu et al. | 156/636 |
| 5,308,438 | 5/1994 | Cote et al. | 156/636 |
| 5,337,015 | 8/1994 | Lustig et al. | 324/671 |
| 5,413,941 | 5/1995 | Koos et al. | 437/225 |
| 5,433,651 | 7/1995 | Lustig et al. | 451/6 |
| 5,486,129 | 1/1996 | Sandhu et al. | 451/5 |
| 5,575,706 | 11/1996 | Tsai et al. | 451/41 |
| 5,595,526 | 1/1997 | Yau et al. | 451/41 |

*Primary Examiner*—Robert A. Rose
*Assistant Examiner*—George Nguyen
*Attorney, Agent, or Firm*—George O. Saile

[57] ABSTRACT

An improved and new process for chemical/mechanical planarization (CMP) of a substrate surface, wherein the removed layer thickness is detected, in-situ, without necessity to remove the substrate from the polishing apparatus has been developed. The method comprises monitoring the temperature of the polishing pad or the polished substrate versus polishing time, integrating the polishing temperature change versus polish time curve with polish time, and applying computer stored integration coefficients to the integrated area to derive the removed thickness.

29 Claims, 5 Drawing Sheets

80 — THICKNESS = $A\alpha_1 + B\varepsilon\alpha_2 + C\alpha_2$

80 THICKNESS = $A\alpha_1 + B\varepsilon\alpha_2 + C\alpha_2$

CHEMICAL/MECHANICAL POLISH (CMP) THICKNESS MONITOR

BACKGROUND OF THE INVENTION (1) Field of the Invention

This invention relates to an apparatus and method for monitoring the removed thickness of a layer during chemical/mechanical polish of the layer. More specifically, the invention is directed to a method of in-situ monitoring the removed thickness of a layer during CMP, without necessity to remove the article from the polishing apparatus.

(2) Description of Related Art

Chemical-mechanical polishing (CMP) has been developed for providing smooth topographies on surfaces deposited on semiconductor substrates. Rough topography results when metal conductor lines are formed over a substrate containing device circuitry. The metal conductor lines serve to interconnect discrete devices, and thus form integrated circuits. The metal conductor lines are further insulated from the next interconnection level by thin films of insulating material and holes formed through the insulating layers provide electrical access between successive conductive interconnection layers. In such wiring processes, it is desirable that the insulating layers have a smooth surface topography, since it is difficult to lithographically image and pattern layers applied to rough surfaces. CMP can, also, be used to remove different layers of material from the surface of a semiconductor substrate. For example, following via hole formation in a dielectric material layer, a metallization layer is blanket deposited and then CMP is used to produce planar metal studs.

Briefly, the CMP processes involve holding and rotating a thin, flat wafer of the semiconductor material against a wetted polishing surface under controlled chemical, pressure, and temperature conditions. A chemical slurry containing a polishing agent, such as alumina or silica, is used as the abrasive material. Additionally, the chemical slurry contains selected chemicals which etch various surfaces of the wafer during processing. The combination of mechanical and chemical removal of material during polishing results in superior planarization of the polished surface. In this process it is important to remove a sufficient amount of material to provide a smooth surface, without removing an excessive amount of underlying materials. Therefore, it is important to monitor the thickness of material removed during the polishing process; or to alternately monitor the thickness of material remaining on the substrate during the polishing process.

In the past, the removal of material has been monitored by interrupting the CMP process, removing the wafer from the polishing apparatus, and physically examining the wafer surface by techniques which ascertain film thickness and/or surface topography. This operation requires additional wafer cleaning steps, labor intensive inspections and measurements, and reduced throughput at the polishing apparatus. If a wafer does not meet specifications, it must be loaded back into the polishing apparatus for further polishing. If excess material has been removed, the wafer may not meet specifications and will be substandard. This endpoint and thickness monitoring method is time consuming, unreliable, and costly. Therefore, numerous improvements to endpoint detection and thickness monitoring during CMP have been invented, as shown in the following patents.

U.S. Pat. No. 5,234,868 entitled "Method For Determining Planarization Endpoint During Chemical-Mechanical Polishing" granted Aug. 10, 1993 to William J. Cote describes a monitor structure surrounded by a moat. The moat causes polish removal to proceed faster at the monitor structure than at regions not surrounded by a moat. Polishing proceeds until the top of the monitor structure is exposed and results in a layer of planarized insulation above the metal pattern not surrounded by a moat. Visual inspection is employed to determine exposure of the top of the monitor structure. Alternately, monitoring is done electrically by detecting an electrical connection between the top of the metal monitor structure and the polishing pad.

U.S. Pat. No. 5,240,552 entitled "Chemical-Mechanical Planarization (CMP) of a Semiconductor Wafer Using Acoustical Waves For In-situ End Point Detection" granted Aug. 31, 1993 to Chris C. Yu et al directs acoustical waves at the wafer during CMP and through analysis of the reflected waveform controls the planarization process.

U.S. Pat. No. 5,308,438 entitled "Endpoint Detection Apparatus and Method For Chemical/Mechanical Polishing" granted May 3, 1994 to William J. Cote et al describes an endpoint detection method in which the power required to maintain a set rotational speed in a motor rotating the substrate is monitored. Endpoint is detectable because the power required to maintain a set rotational speed in a motor rotating the substrate significantly drops when the difficult to polish layer is removed.

U.S. Pat. No. 5,337,015 entitled "In-situ Endpoint Detection Method and Apparatus for Chemical-Mechanical Polishing Using Low Amplitude Input Voltage" granted Aug. 9, 1994 to Naftali E. Lustig et al utilizes electrodes built into the polishing pad, and a high frequency, low voltage signal, and detection means as a method for measuring the thickness of a dielectric layer being polished.

U.S. Pat. No. 5,413,941 entitled "Optical End Point Detection Methods In Semiconductor Planarizing Polishing Processes" granted May 9, 1995 to Daniel A. Koos et al describes a method for endpoint detection for polishing by impinging laser light onto the substrate being polished and measuring the reflected light. The intensity of the reflected light is a measure of the planarity of the polished surface.

U.S. Pat. No. 5,196,353 entitled "Method For Controlling a Semiconductor (CMP) Process By Measuring a Surface Temperature and Developing a Thermal Image of the Wafer" granted Mar. 23, 1993 to Gurtej S. Sandhu et al describes the use of infrared radiation detection to measure the surface temperature of a semiconductor wafer during a polishing process. Sudden changes of temperature at the wafer surface during the polishing process can be used to detect an endpoint.

The present invention is directed to a novel method and apparatus for in-situ monitoring the removed thickness of a layer during CMP, without necessity to remove the article from the polishing apparatus.

SUMMARY OF THE INVENTION

One object of the present invention is to provide an improved and new apparatus and process for chemical/mechanical planarization (CMP) of a substrate surface, wherein the thickness of the removed layer is derived by monitoring the temperature of the polishing process versus time, and computing the thickness of the removed layer from integration of the polish temperature change versus polish time curve.

Another object of the present invention is to provide a new and improved process for chemical/mechanical planarization (CMP) in which, in-situ, the thickness of the removed layer is derived from measurement of the temperature of the polishing pad, monitoring the temperature of the polishing pad versus polishing time, and computing the thickness of the removed layer by integrating the polishing pad temperature change versus polish time curve.

A further object of the present invention is to provide a new and improved process for chemical/mechanical planarization (CMP) in which the uniformity of the removal process is monitored, in-situ, by detecting the temperature of the substrate at a plurality of sites and deriving the removed thickness at each site from the individually integrated site temperature change versus polish time curve.

In an illustrative embodiment, apparatus for carrying out the method of the invention comprises: a wafer carrier and rotating polishing platen for chemically/mechanically planarizing (CMP) the semiconductor wafer, a rotating polishing pad, means of controlling the temperature of a chemical/mechanical polishing slurry, means of dispensing the chemical/mechanical polishing slurry onto the polishing pad, an infrared detection device for monitoring the temperature of the rotating polishing pad, means of storing in a computer memory the temperature of the polishing pad versus polish time, storing in the computer memory integration coefficients for CMP removal chemistry and underlying pattern density, and computation of the thickness of the removed layer versus polish time by integrating the stored temperature change versus polish time data with polish time and applying the stored integration coeffcients.

In a second illustrative embodiment, apparatus for carrying out the method of the invention comprises: a wafer carrier and rotating polishing platen for chemically/mechanically planarizing (CMP) the semiconductor wafer, a rotating polishing pad, means of controlling the temperature of a chemical/mechanical polishing slurry, means of dispensing the chemical/mechanical polishing slurry onto the polishing pad, means of measuring the temperature of the semiconductor substrate at a plurality of sites on the semiconductor substrate, means of storing in a computer memory temperature versus polish time data for each site among the plurality of sites on the semiconductor substrate, storing in the computer memory integration coefficients for CMP removal chemistry and underlying pattern pattern density, and computation of the thickness of the removed layer versus polish time for each site among said plurality of sites on the semiconductor substrate by integrating the stored temperature change versus polish time data with polish time for each site and applying the stored integration coefficients.

BRIEF DESCRIPTION OF THE DRAWINGS

The object and other advantages of this invention are best described in the preferred embodiments with reference to the attached drawings that include.

DESCRIPTION OF THE PREFERRED EMBODIMENTS

The new and improved CMP apparatus and method of planarizing the surface of a semiconductor substrate, using chemical/mechanical polishing (CMP), which results in in-situ monitoring of the removed thickness of a layer during CMP, without necessity to remove the article from the polishing apparatus, will now be described in detail. The method can be used for planarizing insulator surfaces, such as silicon oxide or silicon nitride, deposited by CVD (Chemical Vapor Deposition), LPCVD (Low Pressure Chemical Vapor Deposition), or PE-CVD (Plasma Enhanced Chemical Vapor Deposition) or insulating layers, such as glasses deposited by spin-on and reflow deposition means, over semiconductor devices and/or conductor interconnection wiring patterns.

Figure 1A:
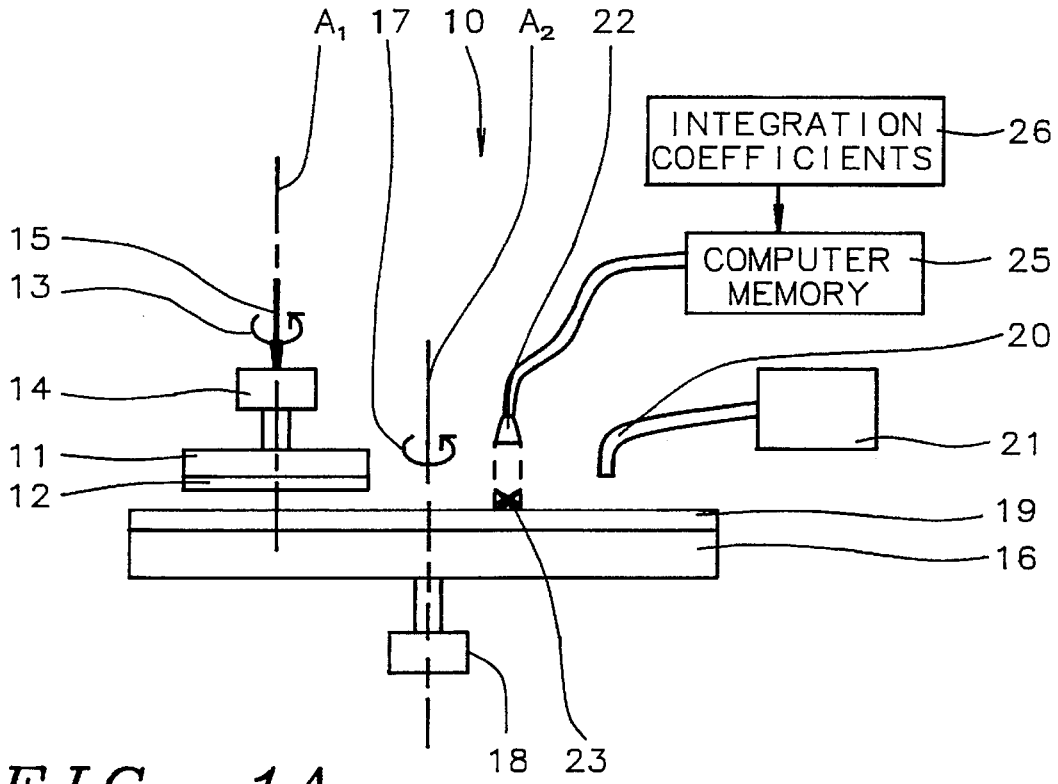
FIG. 1A, which schematically, in cross-sectional representation, illustrates a polishing apparatus, used in accordance with the method of the invention.
Figure 1B:
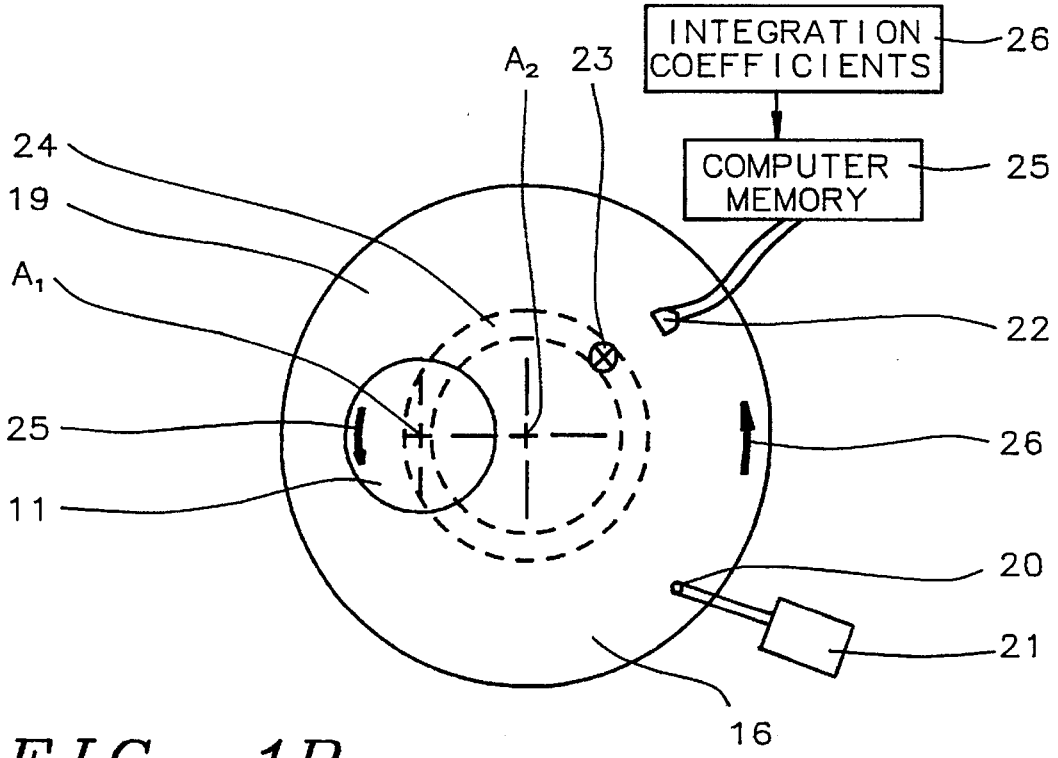
FIG. 1B, which is a top view of the apparatus illustrated in FIG. 1A.

FIGS. 1A and 1B are schematic views of a chemical/mechanical planarization (CMP) apparatus for use in accordance with the method of the invention. In FIG. 1A, the CMP apparatus, generally designated as 10, is shown schematically in cross-sectional representation. The CMP apparatus, 10, includes a wafer carrier, 11, for holding a semiconductor wafer, 12. The wafer carrier, 11, is mounted for continuous rotation about axis, A1, in a direction indicated by arrow, 13, by a drive motor, 14. The wafer carrier, 11, is adapted so that a force indicated by arrow, 15, is exerted on semiconductor wafer, 12. The CMP apparatus, 10, also includes a polishing platen, 16, mounted for continuous rotation about axis, A2, in a direction indicated by arrow, 17, by drive motor, 18. A polishing pad, 19, formed of a material such as blown polyurethane, is mounted to the polishing platen. A polishing slurry containing an abrasive fluid, such as silica or alumina abrasive particles suspended in either a basic or an acidic solution, is dispensed onto the polishing pad, 19, through a conduit, 20, from a temperature controlled reservoir, 21. An infrared radiation detection device, 22, is mounted so as to detect infrared radiation emitted from an area, 23, designated by X. The area, 23, traces an annular ring, 24, on the polishing pad, 19, as shown in FIG. 1B, due to the continuous rotation of the polishing pad, 19. The location of the area, 23, is within the portion of the polishing pad, 19, that abrades the semiconductor wafer, 12, during rotation of the polishing pad, 19. A computer memory, 25, stores the data for temperature of the polishing pad versus polish time during the CMP process. Also, stored in computer memory, 25, are integration coefficients, 26, which are specific for an individual CMP chemistry and underlying pattern density.

Figure 2A:
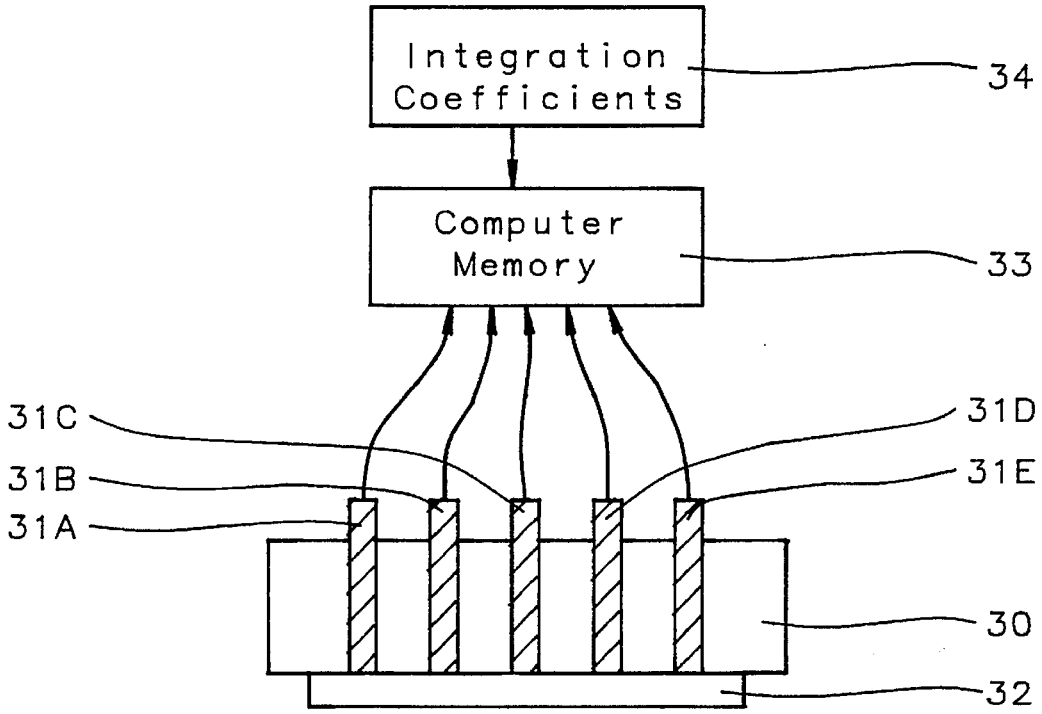
FIG. 2A, which schematically, in cross-sectional representation, illustrates a wafer carrier with multiple temperature measuring devices embedded therein.
Figure 2B:
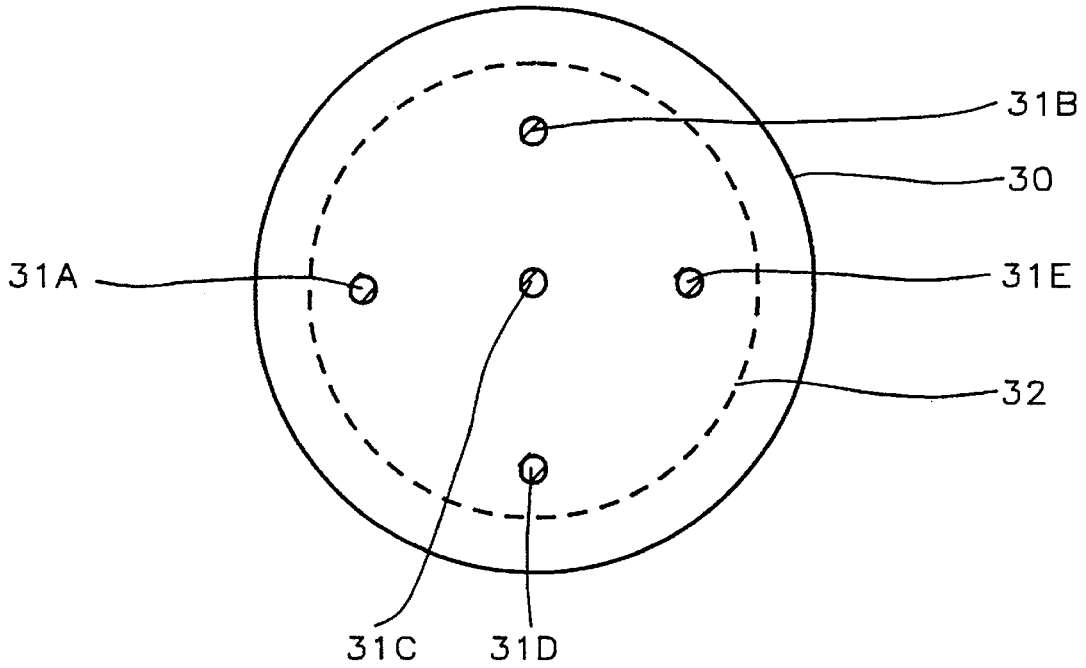
FIG. 2B, which is a top view of the wafer carrier illustrated in FIG. 2A.

In a second embodiment of the present invention, a means of measuring the temperature of the semiconductor substrate at a plurality of sites on the semiconductor substrate is provided, as schematically illustrated in FIGS. 2A and 2B. In FIG. 2A, a wafer carrier, 30, has a plurality of temperature sensors, 31A, 31B, 31C, 31D, and 31E, embedded within said wafer carrier, 30. In this example five sensors are shown; however, the number and location of the sensors may be adjusted to meet the needs of the process. The temperature sensors may be thermocouple devices or other devices for measuring temperature, such as fluro-optic temperature monitors or infrared temperature measurement devices. The temperature sensors, 31A–31E, are positioned so as to monitor the temperature of the backside of the semiconductor substrate, 32, at multiple sites. An illustrative array of five temperature sensors is schematically shown in cross-sectional representation in FIG. 2A and in top view in FIG. 2B. A computer memory, 33, stores the data for temperature of each site on the semiconductor substrate versus polish time during the CMP process. Also, stored in computer memory, 33, are integration coefficients, 34, which are specific for an individual CMP chemistry and underlying pattern density on the semiconductor substrate, 32.

The method of deriving the thickness of the removed layer from measurement of the temperature change at the polish interface will now be described in detail. In a first step approximation the resultant temperature change at the polish interface is due to heat transfer at the interface, as shown below:

Heat Transfer >> >> Temperature Change $$\boxed{\text{Rate of thermal energy in}} - \boxed{\text{Rate of thermal energy out}} + \boxed{\text{Rate of thermal energy production}} = 0$$

$Q = h\Delta T$, where
$\Delta T$ = temperature change
h = the heat capacity, and
Q = Mechanical Heat Flux + Chemical Heat Flux, so
$Q = QM + Qc$
If, $QM = \delta Qc$, then
$Q = QM + Qc = (1 + \delta)Qc$
$Qc = R \times Hc$, where
R = reaction rate of slurry and layer, and
Hc = latent heat of chemical reaction $$R = \text{chemical reaction rate} = k\frac{dL}{dt}, \text{ where}$$

k is the reaction rate constant, and
dL is thickness reacted in time dt $$Q = (1+\delta)Qc = (1+\delta)k\frac{dL}{dt} \equiv h\Delta T$$

Therefore, $$A\frac{dL}{dt} \equiv h\Delta T \text{ and } \frac{dL}{dt} \equiv h\Delta T/A, \text{ where}$$

A is a proportionality constant, so $$L = \int_0^t (h\Delta T/A)dt = \frac{h}{A}\int_0^t \Delta T dt$$

Therefore, thickness removed is proportional to the integration of temperature change with time.

Figure 3:
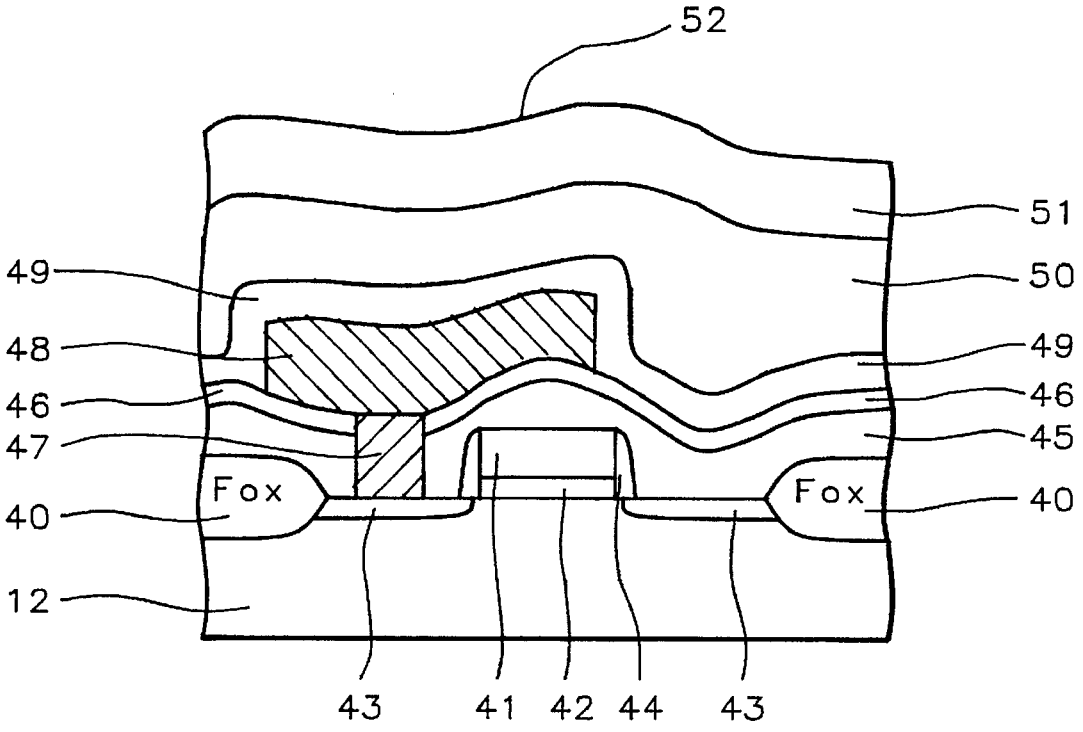
FIGS. 3–4, which schematically, in cross-sectional representation, illustrate planarization of the surface of a composite dielectric layer on a semiconductor substrate.
Figure 4:
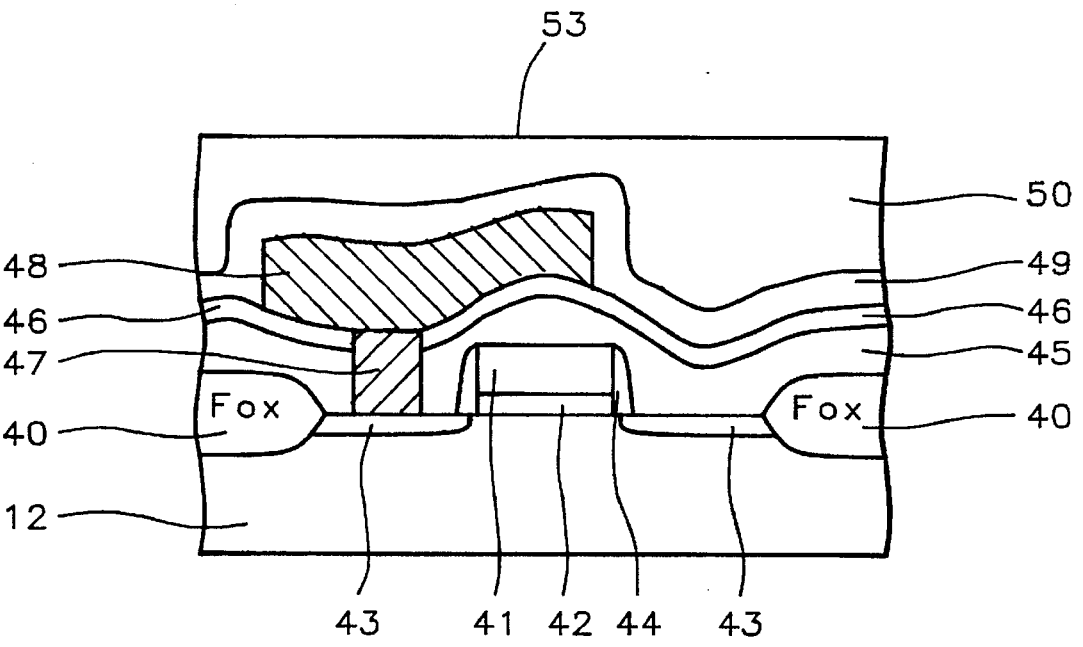

The method of this invention for in-situ monitoring the thickness of removed material is now illustrated in an example where CMP is used to planarize a composite dielectric layer deposited on a semiconductor substrate. FIGS. 3 and 4, schematically in cross-sectional representation, show the chemical/mechanical planarization (CMP) of a semiconductor wafer containing a metallized MOSFET device onto which has been deposited a composite dielectric overlayer of PE-TEOS/SOG/PE-TEOS. PE-TEOS, an insulator common to the semiconductor industry, represents plasma enhanced deposition of silicon oxide from tetraethylorthosilicate. SOG represents spin-on-glass, which is, also, common to the semiconductor industry. A typical NFET, (N-type Field Effect Transistor) device, as shown in FIG. 3, comprises a semiconductor wafer, 12, composed of P-type, single crystal silicon with a <100> orientation; a thick field oxide region, 40, (FOX); a polysilicon gate, 41; gate oxide, 42, source and drain regions, 43; sidewall spacers, 44; LPCVD (Low Pressure Chemical Vapor Deposition) layers of silicon oxide, 45, and silicon nitride, 46; interlevel connecting plug, 47; conducting interconnection pattern, 48; first PE-TEOS layer, 49; SOG layer, 50; and second PE-TEOS layer, 51. The first PE-TEOS layer, 49, is deposited using plasma enhanced deposition from tetraethylorthosilicate, at a temperature between about 200° to 400° C., to a thickness between about 2,000 to 5,000 Angstroms. The SOG layer, 50, comprises application of between about 2 to 4 layers of spin-on-glass, followed by fellow at a temperature between about 250° to 450° C., resulting in a thickness between about 2,000 to 10,000 Angstroms. The second PE-TEOS layer, 51, is deposited using plasma enhanced deposition from tetraethylorthosilicate, at a temperature between about 200° to 400° C., to a thickness between about 2,000 to 5,000 Angstroms. Planarization of the surface topography, 52, shown in FIG. 3, is performed using chemical/mechanical polishing (CMP) in an apparatus as generally illustrated in FIGS. 1A and 1B and results in a substantially planar dielectric layer surface, 53, as shown in FIG. 4.

The method of in-situ measurement of the thickness of removed dielectric layer during CMP of the surface topography, 52, shown in FIG. 3, will now be described in detail. Referring to FIGS. 1A and 1B, a polishing slurry consisting of silica and $NH_4OH$ in $H_2O$, contained in reservoir, 21, is controlled in the temperature range between about 10° to 30° C., and is dispensed through conduit, 20, so as to saturate polishing pad, 19. An infrared radiation detection device, 22, measures the temperature of an area, 23, on the polishing pad, 19. The semiconductor wafer, 12, is placed in the polishing apparatus, 10, with the second PE-TEOS layer, 51, face down against the polishing pad, 19. The polishing platen motor, 18, has its speed set at between about 10 to 70 rpm and the wafer carrier drive motor, 14, is set to rotate at a speed of between about 10 to 70 rpm. The wafer carrier, 11, is set to apply a pressure of between about 1 to 10 psi between the wafer and the polishing pad, through the application of force, 15. During the CMP process the computer memory, 25, stores the data for temperature of the polishing pad versus polish time. For example, the voltage output from the temperature measurement device is coupled to the computer memory through a standard IEEE-488 interface and A/D (Analog to Digital) converter. The digital data is converted to temperature data from a data base of temperature versus voltage, which is commercially available. Also, stored in computer memory, 25, are integration coefficients, 26, which are specific for the CMP chemistry and underlying pattern density on the semiconductor substrate, 12.

Figure 5:
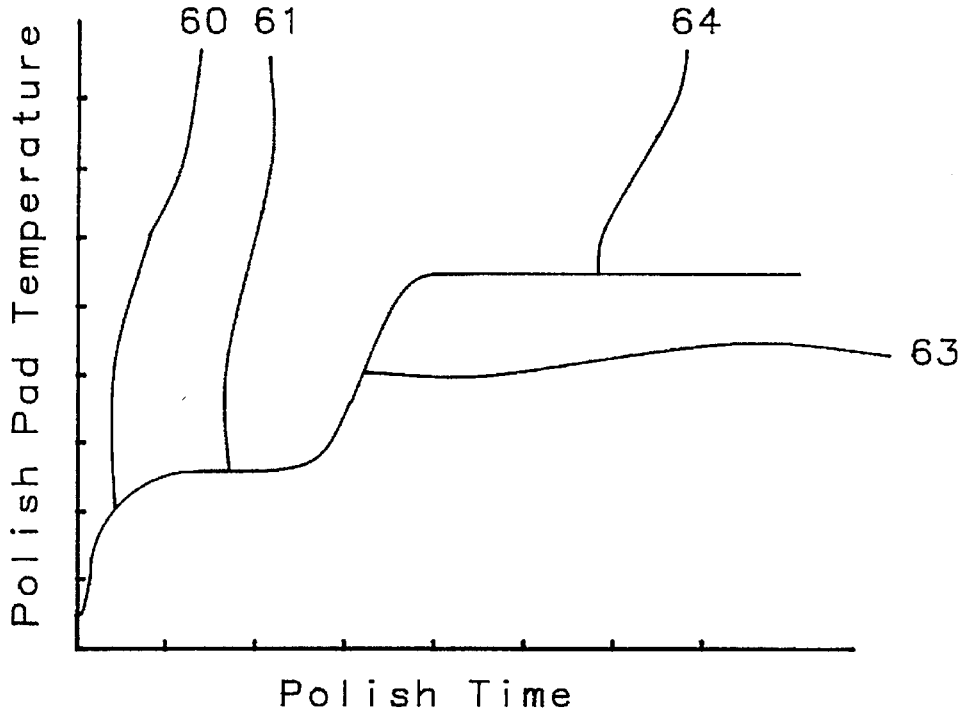
FIG. 5, which shows the behavior of infrared detected polishing pad temperature versus time, when using chemical/mechanical polishing to planarize the surface of a composite dielectric layer on a semiconductor substrate.

FIG. 5 shows the behavior of infrared detected polishing pad temperature versus time, when using chemical/mechanical polishing to planarize the surface, 52, of the semiconductor substrate, shown in FIG. 3. Referring to FIGS. 3 and 5, as the second PE-TEOS layer, 51, first begins to be polished the temperature of the polishing pad increases, indicated by 60, because of the friction between the fibers of the pad, the abrading particles in the polishing slurry, and the PE-TEOS layer. The temperature of the polishing pad remains at a substantially steady level, indicated by 61, during the polishing of the PE-TEOS layer. When the polishing pad makes contact to the SOG layer, 50, which is a more difficult material to polish, the friction between the fibers of the pad, the abrading particles in the polishing slurry, and the polished surface increases and the temperature of the polishing pad increases, as indicated by 63. Finally the temperature of the polishing pad levels off at a higher value, indicated by 64, which is a result of the higher friction between the fibers of the pad, the abrading particles in the polishing slurry, and the SOG layer, 50.

Figure 6:
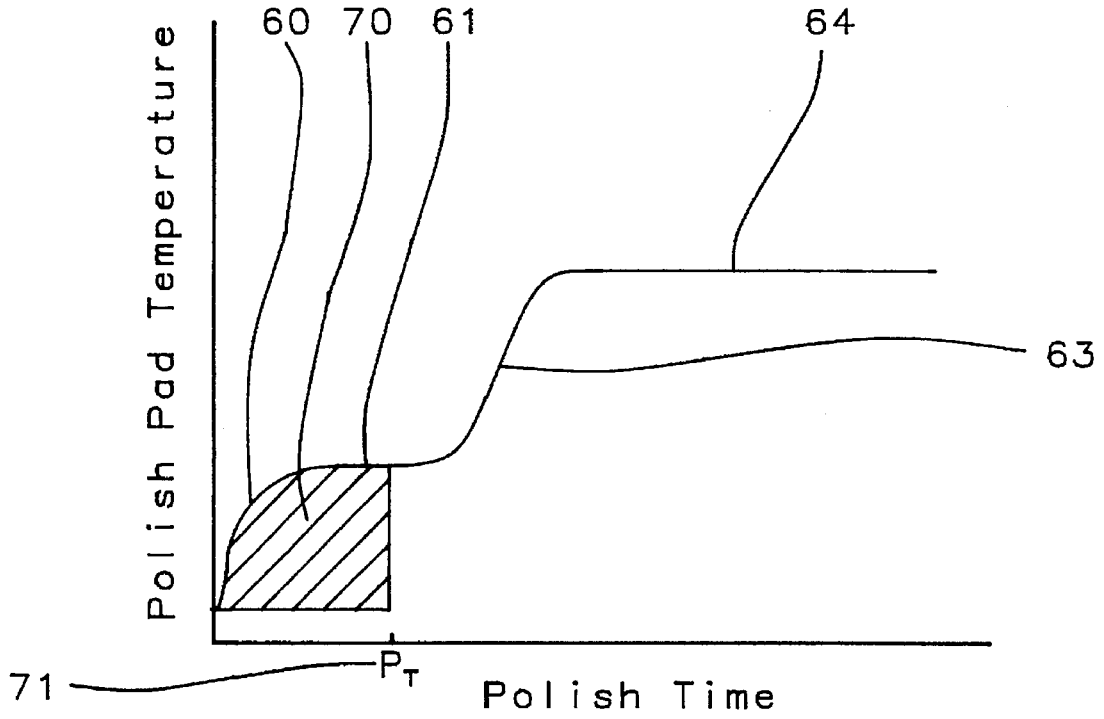
FIG. 6, which shows a curve of polishing pad temperature versus polish time and integration of polishing pad temperature change with polish time to obtain the area under the curve.

In a first step approximation the thickness of the removed layer versus time is obtained by computer integration of the change of polishing pad temperature with polishing time, as shown in FIG. 6. The shaded area, 70, depicts the integration of the change of polishing pad temperature with polishing time. In this first step approximation, this area, 70, the integrated area under the polishing pad temperature change versus polish time curve, is a measurement of the removed thickness at the polish time, $P_T$, indicated as 71.

Figure 7:
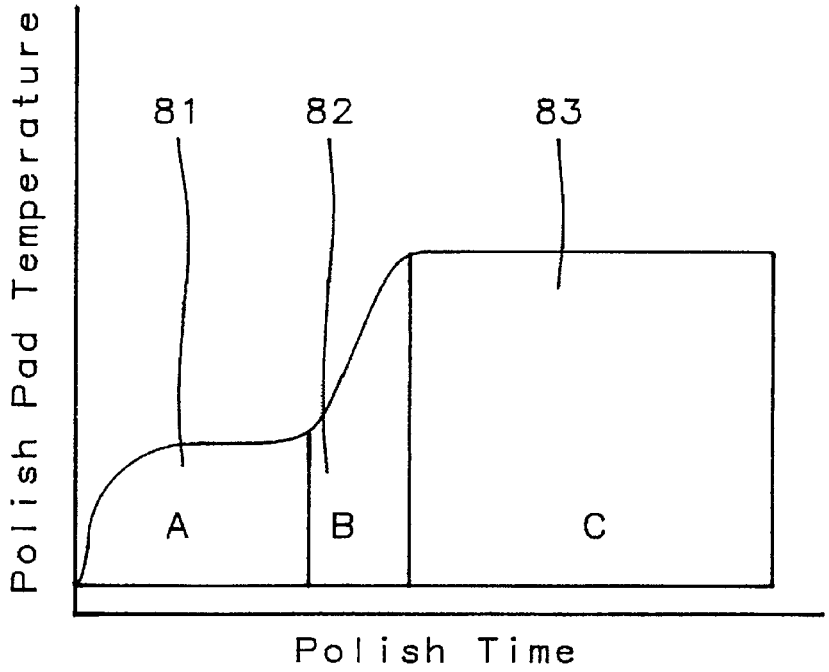
FIG. 7, which shows the application of stored integration coefficients for specific CMP removal chemistry and underlying pattern pattern density and derivation of removed thickness.

FIG. 7 shows the application of stored integration coefficients for the specific CMP removal chemistry and underlying pattern denisty in order to derive a second step approximation, 80, of the removed layer thickness. In region A, indicated by 81, the integrated area, A, is multiplied by stored coefficient, $\alpha_1$, which relates to the polish removal chemistry for PE-TEOS. In region B, indicated by 82, the integrated area, B, is multiplied by stored coefficients, $\epsilon$ and $\alpha_2$. Stored coefficient, $\epsilon$, relates to the pattern density of the underlying structure and stored coefficient, $\alpha_2$, relates to the polish removal chemistry for SOG. In region C, indicated by 83, the integrated area, C, is multiplied by stored coefficient, $\alpha_2$, which relates to the polish removal chemistry for SOG. The removed thickness layer is derived from the summation of the integrated areas with the application of the stored integration coefficients, as shown by equation, 80.

Discussion of experimental results when polishing four semiconductor substrates containing composite dielectric layers deposited over an interconnection pattern further describes the method of the invention. Table 1 lists the parameters of the experiment:

TABLE 1

| Substrate | W23 | W19 | W21 | W20 |
|---|---|---|---|---|
| $\alpha_1$ | 0.71 | 1 | 1 | 1.43 |
| $\epsilon$ | 0.5 | 1 | 1 | 1 |
| $\alpha_2$ | 0.71 | 1 | 1 | 1.50 |
| Slurry | SS-12 | SC112 | SC112 | SS-12 |
| Pad | Stack | Stack | Stack | Stack |
| Bottom layer | PE-$SiH_4$ | PE-TEOS | PE-$SiH_4$ | PE-TEOS |
| 2nd layer | SOG-4x | SOG-2x | SOG-2x | SOG-2x |
| Pattern | T50021 | T50021 | T50021 | T50021 |

Stored coefficient, $\alpha_1$, is related to the polishing chemistry for the slurry and the bottom dielectric layer and the initial topography or smoothness of the substrate. Stored coefficient, $\epsilon$, is related to the pattern density and surface topography due to the underlying structure. Stored coefficient, $\alpha_2$, is related to the polishing chemistry for the slurry and the SOG second layer and the initial topography or smoothness of the SOG second layer.

Substrate W19 corresponds to the nominal condition and all coefficients are 1. Substrate W23 has less initial topography than the other substrates because four layers of SOG have been applied as the second layer. This requires a reduced $\epsilon$ coefficient of $\epsilon$=0.5 for substrate W23. Substrates W21 and W20 have coefficient $\epsilon$=1 because they have the same initial topography as substrate W19. Since substrate W21 uses the same polish slurry SC112 as substrate W19 and the initial topography of substrate W21 is the same as substrate W19, the $\alpha$ coefficients for substrate W21 are $\alpha_1$=1 and $\alpha_2$=1. However slurry SS-12 has a rate for silicon oxide than slurry SC112. Therefore, the $\alpha$ coefficients for substrates W20 and W23 must reflect this fact as well as the effect of initial topography on the CMP polish rate. Substrate W20, which has the same initial topography as substrate W19 has a coefficients which correspond to the higher CMP polish rate for silicon oxide in slurry SS-12 and are $\alpha_1$=1.43 and $\alpha_2$=1.50. Adjustment of the $\alpha$ coefficients for the smaller initial topography of substrate W23 compared to substrate W19 results in $\alpha$ coefficients of $\alpha_1$=0.71 and $\alpha_2$=0.71 for substrate W23.

Figure 8:
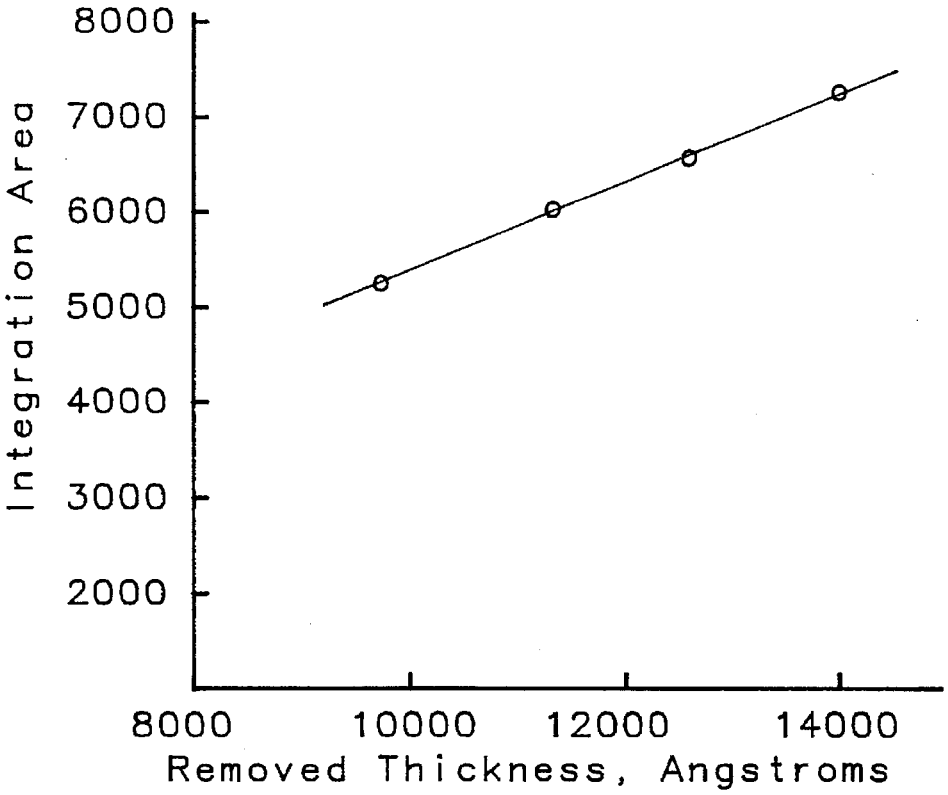
FIG. 8, shows an example of removed thicknesses as derived from the integration of polishing pad temperature change with polish time and application of integation coefficients for specific CMP removal chemistry and underlying pattern density.

FIG. 8, shows the removed dielectric thickness for each of the four substrates in the experiment, as derived from the integration of polishing pad temperature change with polish time and application of integation coefficients for specific CMP removal chemistry and underlying pattern density for each of the four substrates.

While the invention has been particularly shown and described with reference to the preferred embodiments thereof, it will be understood by those skilled in the art that various changes in form and details may be made without departing from the spirit and scope of the invention.

What is claimed is:

1. A method of chemical/mechanical planarization (CMP) of a semiconductor substrate comprising:

planarizing the semiconductor substrate by holding the semiconductor substrate on a rotating platen against a rotating polishing pad in the presence of a polishing slurry;

controlling the temperature of the polishing slurry in the temperature range between about 10° to 30° C.;

dispensing said temperature controlled slurry onto said rotating polishing pad;

measuring by infrared detection means the temperature of said rotating polishing pad at a selected polishing pad location which is abrading the surface of said semiconductor substrate;

storing in a computer memory the temperature of the polishing pad versus polish time;

storing in the computer memory integration coefficients for CMP removal chemistry and underlying pattern density; and computing the thickness of the removed layer vesus polish time by integrating the stored temperature change versus polish time data with time and applying the stored integration coefficients.

2. The method of claim 1, wherein said polishing slurry comprises silica and $NH_4OH$ in $H_2O$.

3. The method of claim 1, wherein said temperature of said rotating polishing pad is measured in the temperature range between about 10° to 80° C.

4. A method of chemical/mechanical planarization (CMP) of a semiconductor substrate comprising:

planarizing the semiconductor substrate by holding the semiconductor substrate on a rotating platen against a rotating polishing pad in the presence of a polishing slurry;

controlling the temperature of the polishing slurry in the temperature range between about 10° to 30° C.;

dispensing said temperature controlled slurry onto said rotating polishing pad;

measuring the temperature of said semiconductor substrate at a plurality of sites on the semiconductor substrate;

storing in a computer memory temperature versus polish time data for each site among said plurality of sites on the semiconductor substrate;

storing in the computer memory integration coefficients for CMP removal chemistry and underlying pattern density; and computing the thickness of the removed layer versus polish time for each site among said plurality of sites on the semiconductor substrate by integrating the stored temperature change versus polish time data with time for each site and applying the stored integration coefficients.

5. The method of claim 4, wherein said polishing slurry comprises silica and $NH_4OH$ in $H_2O$.

6. The method of claim 4, wherein the temperature of said semiconductor substrate is measured at at least one site on the semiconductor substrate.

7. The method of claim 4, wherein said temperature of said semiconductor substrate is measured in the temperature range between about 10° to 80° C.

8. A method for fabricating a planarized layer of dielectric material on a semiconductor substrate containing a structure, comprising the steps of:

providing said structure on said semiconductor substrate;

depositing a layer of dielectric material onto said semiconductor substrate containing said structure;

planarizing said layer of dielectric material by holding said semiconductor substrate on a rotating platen against a rotating polishing pad in the presence of a polishing slurry and applied pressure between the platen and polishing pad;

controlling the temperature of the polishing slurry in the temperature range between about 10° to 30° C.;

dispensing the temperature controlled slurry onto the rotating polishing pad;

measuring by infrared detection means the temperature of the polishing pad at a location which is abrading the surface of said layer of dielectric material;

storing in a computer memory the temperature of the polishing pad versus polish time;

storing in the computer memory integration coefficients for CMP removal chemistry and underlying pattern density; and computing the thickness of the removed layer versus polish time by integrating the stored temperature change versus polish time data with time and applying the stored integration coefficients.

9. The method of claim 8, wherein said structure is an active device.

10. The method of claim 8, wherein said structure is an interconnection pattern of conducting material.

11. The method of claim 8, wherein said structure comprises both active devices and an interconnection pattern of conducting material.

12. The method of claim 9, wherein said active device is a NFET or PFET MOS device.

13. The method of claim 10, wherein said interconnection pattern of conducting material is aluminum having a thickness between about 4,000 to 10,000 Angstroms.

14. The method of claim 8, wherein said layer of dielectric material is silicon oxide deposited using PECVD, at a temperature between about 200° to 400° C., to a thickness between about 2,000 to 5,000 Angstroms.

15. The method of claim 8, wherein said polishing slurry comprises silica and $NH_4OH$ in $H_2O$, controlled in the temperature range between about 10° to 30° C.

16. The method of claim 8, wherein said rotating polishing pad is rotated in a range between about 10 to 70 rpm.

17. The method of claim 8, wherein said rotating platen is rotated in a range between about 10 to 70 rpm.

18. The method of claim 8, wherein said applied pressure between the platen and polishing pad is in a range between about 1 to 10 psi.

19. A method for fabricating a planarized layer of dielectric material on a semiconductor substrate containing a structure, comprising the steps of:

providing said structure on said semiconductor substrate;

depositing a layer of dielectric material onto said semiconductor substrate containing said structure;

planarizing said layer of dielectric material by holding said semiconductor substrate on a rotating platen against a rotating polishing pad in the presence of a polishing slurry and applied pressure between the platen and polishing pad;

controlling the temperature of the polishing slurry in the temperature range between about 10° to 30° C.;

dispensing the temperature controlled slurry onto the rotating polishing pad;

measuring the temperature of said semiconductor substrate at a plurality of sites on the semiconductor substrate;

storing in a computer memory temperature versus polish time data for each site among said plurality of sites on the semiconductor substrate;

storing in the computer memory integration coefficients for CMP removal chemistry and underlying pattern density; and computing the thickness of the removed layer versus polish time for each site among said plurality of sites on the semiconductor substrate by integrating the stored temperature change versus polish time data with time for each site and applying the stored integration coefficients.

20. The method of claim 19, wherein said structure is an active device.

21. The method of claim 19, wherein said structure is an interconnection pattern of conducting material.

22. The method of claim 19, wherein said structure comprises both active devices and an interconnection pattern of conducting material.

23. The method of claim 20, wherein said active device is a NFET or PFET MOS device.

24. The method of claim 21, wherein said interconnection pattern of conducting material is aluminum having a thickness between about 4,000 to 10,000 Angstroms.

25. The method of claim 19, wherein said layer of dielectric material is silicon oxide deposited using PECVD, at a temperature between about 200° to 400° C., to a thickness between about 2,000 to 5,000 Angstroms.

26. The method of claim 19, wherein said polishing slurry comprises silica and $NH_4OH$ in $H_2O$, controlled in the temperature range between about 10° to 30° C.

27. The method of claim 19, wherein said rotating polishing pad is rotated in a range between about 10 to 70 rpm.

28. The method of claim 19, wherein said rotating platen is rotated in a range between about 10 to 70 rpm.

29. The method of claim 19, wherein said applied pressure between the platen and polishing pad is in a range between about 1 to 10 psi.

* * * * *